US005640790A

United States Patent [19]

Johns

[11] Patent Number: 5,640,790

[45] Date of Patent: Jun. 24, 1997

[54] COLLECTOR'S PLATE KIT

[75] Inventor: Daniel M. Johns, Maumee, Ohio

[73] Assignee: Craft House Corporation, Toledo, Ohio

[21] Appl. No.: 566,044

[22] Filed: Dec. 1, 1995

[51] Int. Cl.[6] ..... G09F 03/08

[52] U.S. Cl. ..... 40/324

[58] Field of Search ..... 40/324, 611

[56] References Cited

U.S. PATENT DOCUMENTS

| | | | |
|---|---|---|---|
| 222,594 | 12/1879 | Marra | 40/324 |
| 357,689 | 2/1887 | Porrera | 40/324 |
| 2,224,683 | 12/1940 | Ide et al. | 40/324 |
| 3,515,262 | 6/1970 | Ornstein et al. | 40/324 X |
| 4,176,843 | 12/1979 | DeWitt, Jr. | 40/324 X |

*Primary Examiner*—Joanne Silbermann

*Attorney, Agent, or Firm*—Donald R. Fraser

[57] ABSTRACT

A collector's plate kit is described. The kit includes an outer frame member and a selectively immovable inner member carrying decorative design indicia thereon which may be painted by the collector to suit any particular design scheme.

1 Claim, 3 Drawing Sheets

COLLECTOR'S PLATE KIT

BACKGROUND OF THE INVENTION

1. Field of the Invention

The present invention relates to crafts and hobbies and more particularly to kit for producing a collector's plate.

Collector plates are well known to those who deal in antiques and persons involved in the collection of objects of art, for example. Examples of collector plates are those with Christmas schemes, plates with paintings of Hummel figurines, and various other commemorative issues.

2. Prior Art

Normally, collector plates are regarded primarily as decorative works of art and utilized as integral portions of an individual's interior design. Also, collector plates are collected by one generation with the objective of passing the collection on to future generations. These works of art contain the original renditions of paintings, etchings or designs, and are produced through the creative talents of others.

SUMMARY OF THE INVENTION

The present invention involves the collector's plate concept wherein the collector may select any particular design scheme or theme and individually produce the desired number of plates.

It is accordingly a primary object of the present invention to produce a collector's plate kit enabling a collector to select any one of a large number of plate designs each of which is capable of receiving a distinct central decorative panel.

Another object of the invention is to produce a collector's plate kit wherein the outer frame or marginal edge portions are adapted to selectively removably receive a central panel capable of bearing decorative indicia selected by the collector.

Another object of the invention is to produce a collector's plate kit which includes an outer frame member and a removably attachable central panel carrying decorative indicia thereon.

Typically, the above objects and advantages of the invention may be achieved by a collector's plate kit comprising an outer frame member defining an inner opening; and an inner member selectively removably received within the inner opening of the outer frame member.

Further objects and advantages of this invention will be apparent from the following description and appended claims, reference being made to the accompanying drawings forming a part of the specification, wherein like reference characters designate corresponding parts in the several views.

BRIEF DESCRIPTION OF THE DRAWINGS

Other objects and advantages of the invention will become readily apparent to one skilled in the art from reading the following detailed description of an embodiment of the invention when considered in the light of the accompanying drawings, in which.

DETAILED DESCRIPTION OF THE PREFERRED EMBODIMENTS

Figure 1:
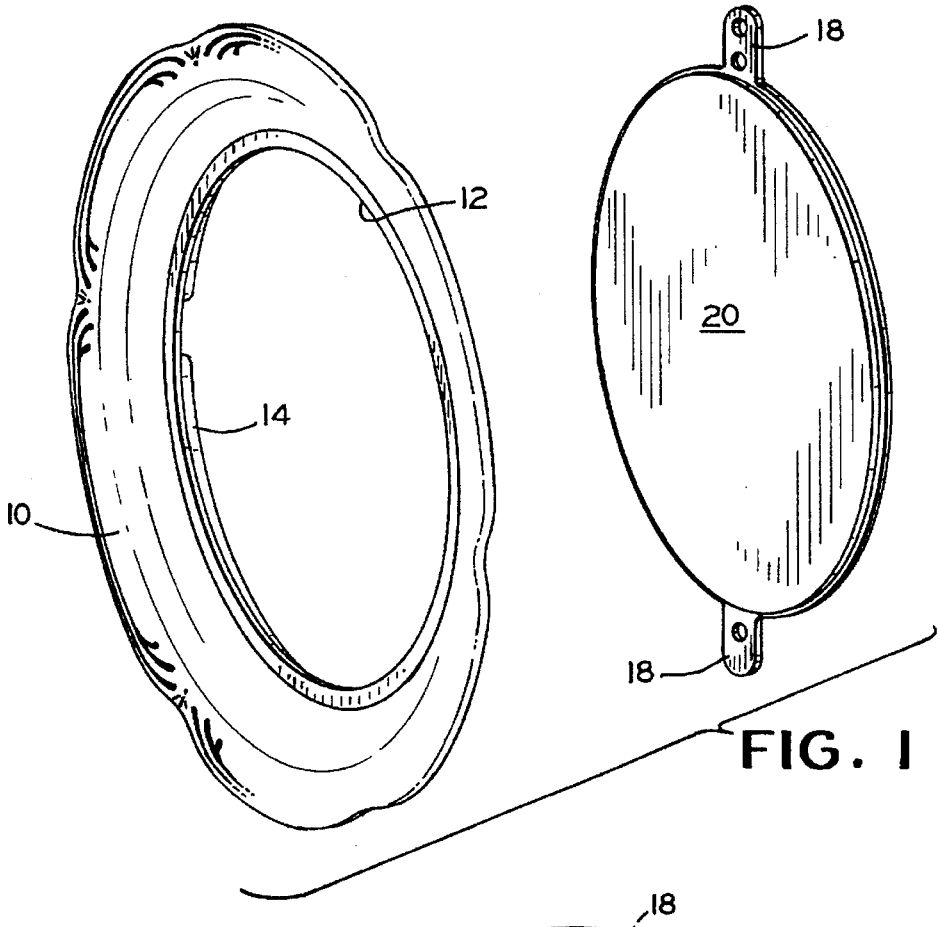
FIG. 1 is an exploded perspective view of a collector's plate kit incorporating the features of the invention.
Figure 2:
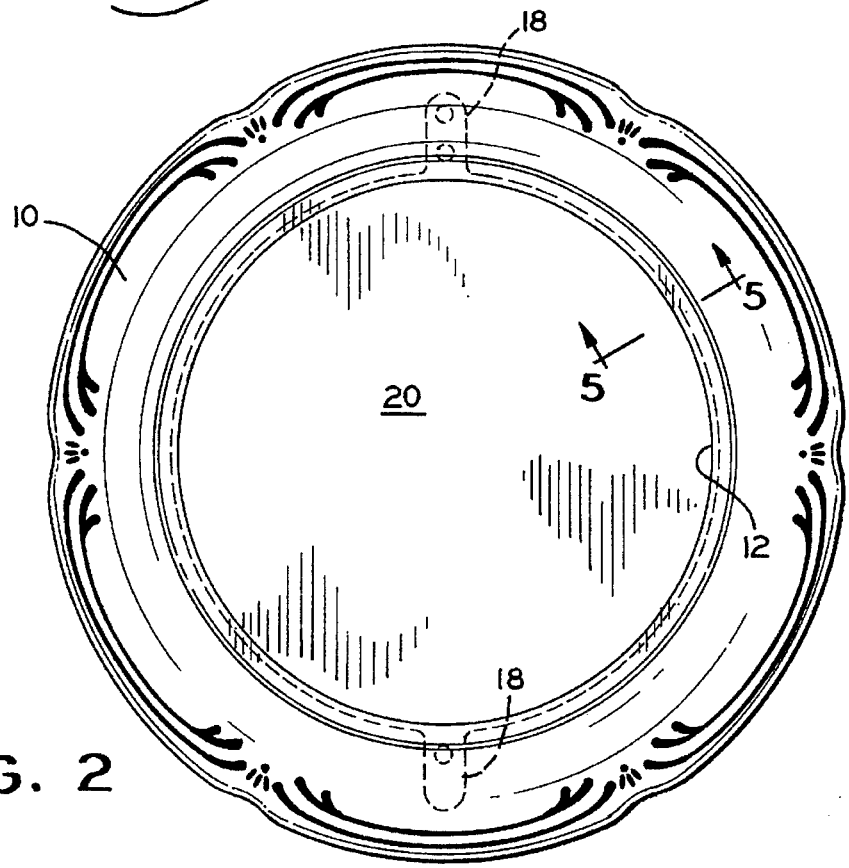
FIG. 2 is top plan view of the invention illustrated in FIG. 1 in an assembled condition.
Figure 3:
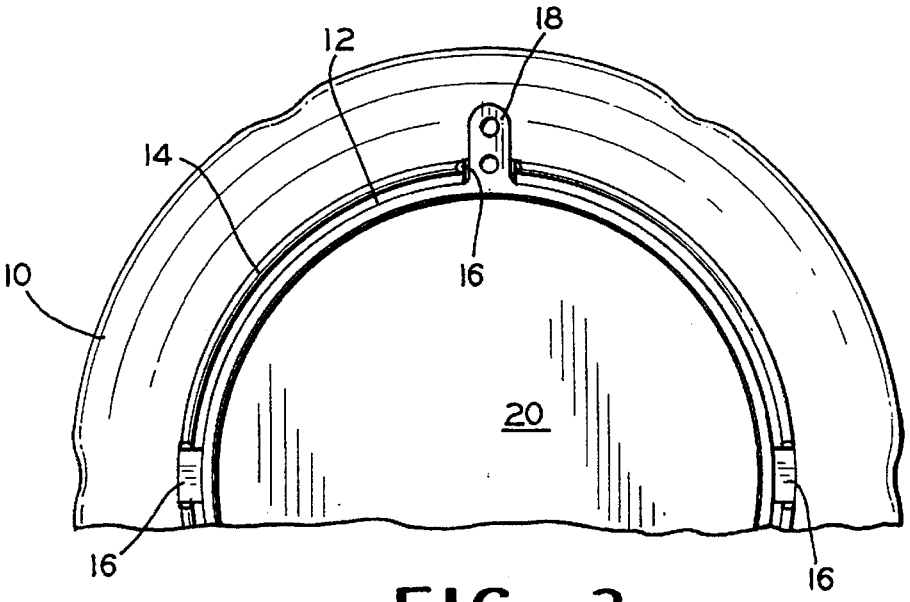
FIG. 3 is a fragmentary rear view of the invention illustrated in FIG. 2.
Figure 4:
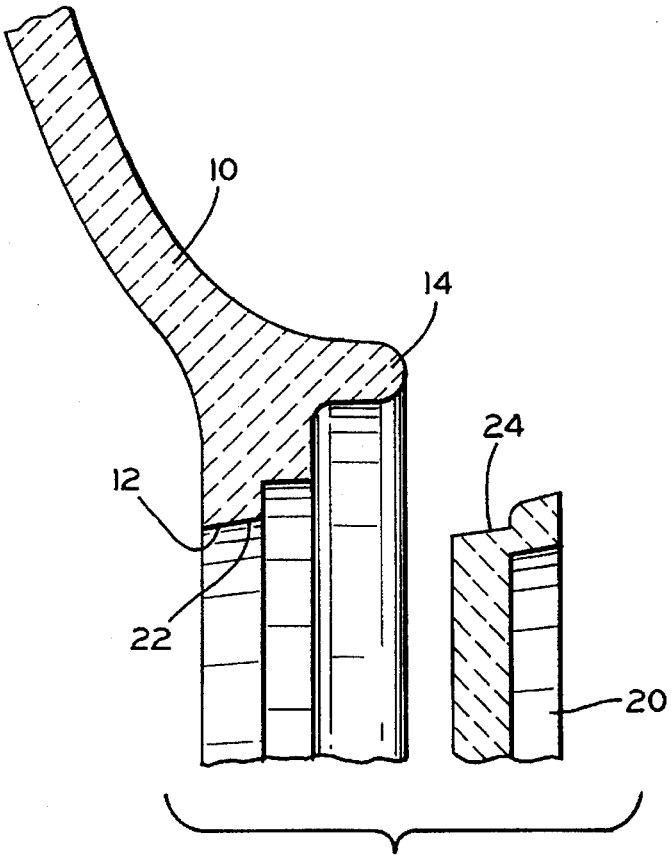
FIG. 4 is an enlarged exploded fragmentary sectional view of the illustrated invention showing the configuration of the inner opening of the outer frame member.
Figure 5:
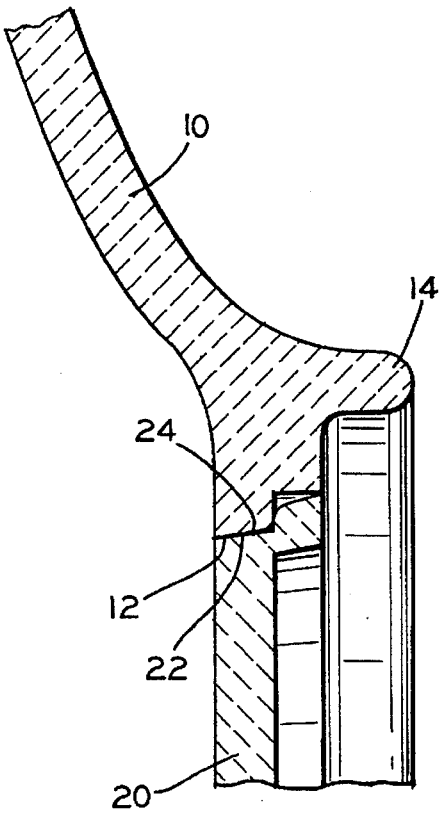
FIG. 5 is an enlarged sectional view taken along line 5—5 of FIG. 2.

Referring to the drawings, there is illustrated a collector's plate kit which typically includes an outer frame member 10 having an inner edge portion 12 which defines an inner opening. The frame 10 can be formed of a variety of plastic materials. However, it has been found that high impact resistant polystyrene has many desirable characteristics and can be injection molded to produce the desired configuration within the required economic parameters.

The facing surface of the frame member 10 may be provided sculptured design configurations of the type illustrated, or may contain any other desired appearance.

The opposite surface which typically is disposed to face a supporting surface such as a wall, for example, is provided with an outwardly extending quadrantly interrupted rib 14. Quadrantly disposed interruptions 16 are provided to receive fastener receiving tabs 18 formed to extend outwardly from an inner member 20 as will be explained in more detail hereinafter.

The frame member 10 includes an annular stepped shoulder 22 disposed radially inwardly of the rib 14. The shoulder 22 defines the radially innermost portion of the outer frame member 10. The innermost portion of the stepped shoulder 22 is angularly disposed at approximately ten degrees (10°) from a line perpendicular to the general plane of the frame 10.

The associated inner member 20 is provided with an outwardly extending stepped shoulder 24. The innermost portion of the stepped shoulder 24 is angularly disposed at approximately eight degrees (8°) from a line perpendicular to the general plane or the inner member 20.

It will be noted that the depth of the angularly disposed portions of the stepped shoulders 22,24 of the outer frame member 10 and the inner member 20, respectively, are of substantially identical depth. Therefore, when the inner member 20 is fitted within the opening of the outer frame member 10, the joining planar exposed surfaces of the two members is flat and uninterrupted.

The diameter of the opening 12 defined by the stepped shoulder 22 is slightly larger than the diameter of stepped shoulder 24 of the inner member 20. This relationship, coupled with the fact that the draft of the angled portion of the stepped shoulder 22 is slightly larger than the draft of the angled portion of the stepped shoulder 24, provides for a snap-press fit between the frame member 10 and the inner member 20.

Figure 6:
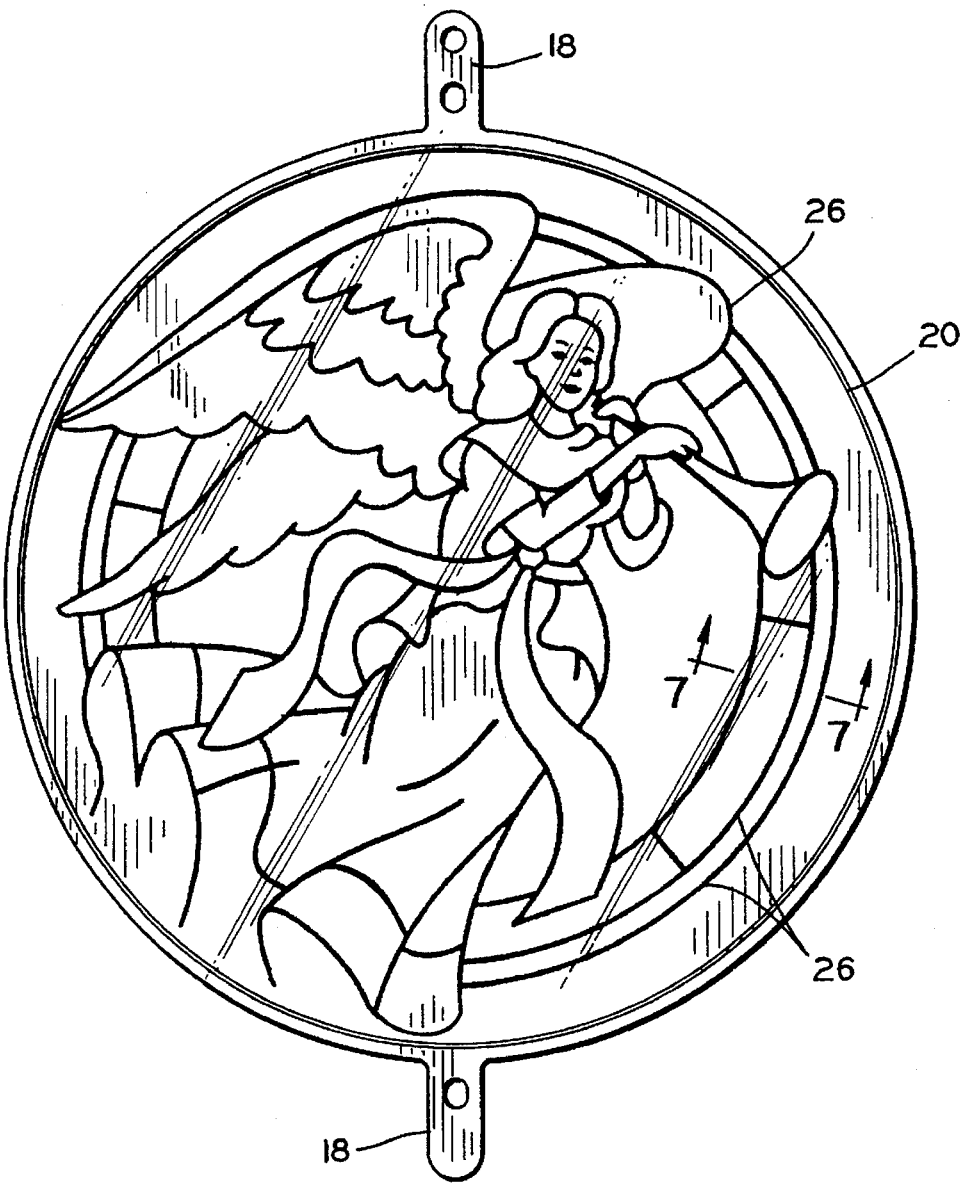
FIG. 6 is a bottom plan view of an embodiment of the inner member.
Figure 7:
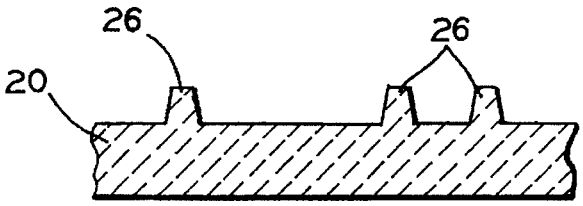
FIG. 7 is a fragmentary sectional view taken along lines 7—7 of FIG. 6.

While the inner member 20 may be formed of a variety of plastic materials, it has been found that the utilization of a crystal polystyrene has resulted in many advantages. By forming the inner member 20 of a crystal polystyrene, the resultant structure is transparent permitting the under surface to be imprinted with decorative indicia thereon, such as is illustrated in FIGS. 6 and 7.

The outline of the decorative indicia is typically formed on the under surface of the inner member 20 by the die used to form the member 20. The outline of the decorative indicia is comprised of a plurality of outwardly projecting ribs 26, the outermost portions of which may be hot stamped in black or gold foil, for example. The ribs 26 function as an outline to facilitate and guide an assembler in the application of appropriate translucent paints such as acrylic stain within the areas defined by the ribs 26. While translucent colorings have been found to be satisfactory, it will be understood that opaque paints such as acrylic paint may be used in coloring the particular decorative design imprinted on the inner member 20.

Also, the inner member 20 may be formed of a plastic material which is translucent as distinguished from transparent. The translucent material will tend to diffuse the light transmitted therethrough and thereby dictate the particular type of design utilized.

The inner member 20 could also be formed of an opaque plastic material, such as an acrylic resin containing opaque filler material, for example. In such instances, the decorative design would be imprinted on the upper or facing surface of the inner member 20.

After the artwork is completed and the inner member 20 is press-fitted in the outer frame member 10, the assemblage may be hung on a wall for display by disposing a fastener in the wall into the hole in the appropriate tab 18.

In accordance with the provisions of the patent statutes, the present invention has been described in what is considered to represent its preferred embodiment. However, it should be understood that the invention can be practiced otherwise than as specifically illustrated and described without departing from its spirit or scope.

What is claimed is:

1. A collector's plate kit comprising:

a) an outer frame member having an upper surface and a lower surface and an inner opening, radially inwardly extending stepped shoulder including an inner edge portion extremely around and defining the inner opening and extending from the upper surface and terminating in a stepped portion, the inner edge portion being angularly disposed from a line perpendicular to the general plane of said outer frame member, an annular rib extending outwardly from the lower surface of said frame member and surrounding the inner opening for supporting said outer frame member from a supporting surface, the rib having a series of spaced apart interruptions; and b) a selectively removable inner member adapted to be received within the inner opening of said outer frame member including an upper surface planar surface and a lower planar surface, and a radially outwardly extending annular shoulder including an outer edge portion being angularly disposed from a line perpendicular to the general plane of said inner member forming a press-fit with the inner edge portion of said outer frame member and at least one radially outwardly extending mounting fastener receiving tab formed to extend in a plane generally parallel to general plane of said inner member, the tab adapted to be selectively positioned within one of the spaced apart interruptions in the annular rib of said outer frame member and adapted to extend along and spaced inwardly of the lower surface of said outer frame member, and having thickness less than the extension of the annular rib of said outer frame member.

* * * * *